US006323814B1

(12) United States Patent
Apostolos

(10) Patent No.: US 6,323,814 B1
(45) Date of Patent: Nov. 27, 2001

(54) WIDEBAND MEANDER LINE LOADED ANTENNA

(75) Inventor: John T. Apostolos, Merrimack, NH (US)

(73) Assignee: BAE Systems Information and Electronic Systems Integration INC, Nashua, NH (US)

( * ) Notice: Subject to any disclaimer, the term of this patent is extended or adjusted under 35 U.S.C. 154(b) by 0 days.

(21) Appl. No.: 09/865,115

(22) Filed: May 24, 2001

Related U.S. Application Data

(60) Provisional application No. 60/206,926, filed on May 24, 2000, and provisional application No. 60/206,922, filed on May 24, 2000.

(51) Int. Cl.[7] ..... H01Q 11/14

(52) U.S. Cl. ..... 343/744; 343/741; 343/745

(58) Field of Search ..... 343/700 MS, 728, 343/741, 742, 743, 744, 745, 749, 829, 846, 866, 867; H01Q 1/24, 1/36, 1/38, 11/14

(56) References Cited

U.S. PATENT DOCUMENTS

| | | | | |
|---|---|---|---|---|
| 3,633,207 | * | 1/1972 | Ingerson | 343/770 |
| 4,243,990 | | 1/1981 | Nemit et al. . | |
| 4,293,858 | | 10/1981 | Hockham . | |
| 4,656,482 | * | 4/1987 | Peng | 343/705 |
| 4,804,965 | | 2/1989 | Roederer . | |
| 5,086,301 | | 2/1992 | English et al. . | |
| 5,481,272 | | 1/1996 | Yarsunas . | |
| 5,563,616 | | 10/1996 | Dempsey et al. . | |
| 5,784,032 | | 6/1998 | Johnson et al. . | |
| 5,790,080 | | 8/1998 | Apostolos . | |
| 5,867,126 | * | 2/1999 | Kawahata et al. | 343/702 |
| 5,898,409 | | 4/1999 | Holzman . | |
| 5,926,139 | * | 7/1999 | Korisch | 343/702 |
| 5,936,587 | * | 8/1999 | Gudilev et al. | 343/752 |
| 6,008,762 | | 12/1999 | Nghiem . | |
| 6,025,812 | | 2/2000 | Gabriel et al. . | |
| 6,034,637 | | 3/2000 | McCoy et al. . | |
| 6,061,035 | * | 5/2000 | Kinasewitz et al. | 343/853 |
| 6,094,170 | | 6/2000 | Peng . | |
| 6,166,694 | * | 12/2000 | Ying | 343/702 |

FOREIGN PATENT DOCUMENTS

| | | |
|---|---|---|
| wo 98/49742 | 11/1998 | (WO) . |
| wo 01/13464 | 2/2001 | (WO) . |

* cited by examiner

*Primary Examiner*—Tho G. Phan
(74) *Attorney, Agent, or Firm*—Scott J. Asmus; Vernon C. Maine

(57) ABSTRACT

A meander line loaded antenna provides a wide instantaneous bandwidth with a first planar conductor extending orthogonally from a ground plane, a second planar conductor substantially parallel to the ground plane and separated from the first planar conductor by a gap, a meander line interconnecting the first and second planar conductors across the gap, and a third conductor connecting the second planar conductor to ground. A fourth conductor provides enhanced capacitance between the first and second planar conductors. The antenna may be arranged in opposed pairs, and also as two orthogonally opposed pairs for enabling circular polarization.

12 Claims, 9 Drawing Sheets

WIDEBAND MEANDER LINE LOADED ANTENNA

RELATED APPLICATION

Applicant hereby claims the priority benefits in accordance with the provisions of 35 U.S.C. §120, basing said claim on U.S. Provisional Patent Applications Ser. Nos. 60/206,926 and 60/206,922, both filed May 24, 2000.

FIELD OF THE INVENTION

The present invention generally relates to high frequency, loop antennas and, particularly, to such antennas having a series reactance in the loop.

BACKGROUND OF THE INVENTION

In the past, efficient antennas have typically required structures with minimum dimensions on the order of a quarter wavelength of the lowest operating frequency. These dimensions allowed the antenna to be excited easily and to be operated at or near a resonance, limiting the energy dissipated in impedance losses and maximizing the transmitted energy. These antennas tended to be large in size at the resonant wavelength, and especially so at lower frequencies.

DISCUSSION OF THE RELATED ART

In order to address the shortcomings of traditional antenna design and functionality, the meander line loaded antenna (MLA) was developed. One such antenna is disclosed in U.S. Pat. No. 5,790,080 for MEANDER LINE LOADED ANTENNA, issued to John T. Apostolos, the inventor of the present application, the contents of which are hereby incorporated by reference.

The aforementioned U.S. Pat. No. 5,790,080 describes an antenna that includes two or more conductive elements acting as radiating antenna elements, and a slow wave meander line adapted to couple electrical signals between the conductive elements. The meander line has an variable physical length which affects the electrical length and operating characteristics of the antenna. The electrical length of the meander line, and therefore the antenna, may be readily controlled.

A typical MLA 100, as shown in FIG. 1 includes two, spaced-apart vertical conductors 102 and a horizontal conductor 104. The vertical and horizontal conductors are separated by gaps 106, which are bridged by meander lines 108. Meander lines 108 include a slow wave structure having sequential sections with alternating high and low impedance values, which structure provides an electrical length that is greater than its physical length.

Meander line 108 is characterized by a plurality of series connected sections 110, 112. Sections 110, 112 are alternately sequentially connected and are designed to have respective high and low characteristic impedance values, which impedance values are consequently alternated by the alternating sequential connection. These alternating impedance values create a slow wave structure having an effective electrical length that is greater than the actual physical length. This impedance structure may be formed by a transmission line having sections which alternate in their separation from a ground plane. In FIG. 2, high impedance sections 110 are suspended above the top surface of a dielectric sheet 114 and low impedance sections are formed as conductors directly on the top surface of dielectric sheet 114. Placing the dielectric sheet against a planar conductor creates the different impedance values because the planar conductor acts as an effective ground plane. In the antenna 100 of FIG. 1, the vertical conductors 102 are used to create that ground plane for meander lines 108.

Meander lines 108 are also designed to allow adjustment of their length. The slow wave structure permits lengths of the meander line to be switched in or out of the circuit quickly and with negligible loss, in order to change the effective length of the antenna. This switching is possible because the active switching devices are always located between the high and low impedance sections of the meander line. This keeps the current through the switching device low and results in very low dissipation losses in the switch, thereby maintaining high antenna efficiency.

FIG. 3, shows four typical operating modalities for the MLA 100 in combination with the meander line 108. The operating frequency and meander line lengths are alternatively shown as quarter wavelength, $1/2\lambda$, $1\lambda$, and $3/2\lambda$. The simple, basic MLA can be operated in a loop mode that provides a "Figure eight" coverage pattern. Horizontal polarization, loop mode, may be obtained when the antenna is operated at a frequency such that the electrical length of the entire line, including the meander lines, is a multiple of a full wavelength. The antenna can also be operated in a vertically polarized, monopole mode, by adjusting the electrical length to an odd multiple of a half wavelength at the operating frequency. The meander lines can be tuned using electrical or mechanical switches to change the mode of operation at a given frequency using a given mode.

The MLA allows the physical dimensions of antennas to be significantly reduced while maintaining an electrical length that is still a multiple of a quarter wavelength. Antennas and radiating structures built using this design operate in the region where the limitation on their fundamental performance is governed by the Chu-Harrington relation. Meander line loaded antennas achieve the efficiency limit of the Chu-Harrington relation while allowing the antenna size to be much less than a quarter wavelength at the frequency of operation. Height reductions of 10 to 1 can be achieved over quarter wave monopole antennas while achieving comparable gain.

The prior art MLA antennas have relatively narrow instantaneous bandwidth. Although the switchable meander line allows the antennas to have a very wide tunable bandwidth, the bandwidth available for simultaneous use is relatively limited. Thus for multi-band or multi-use applications and for applications where signals can appear unexpectedly over a wide frequency range, existing MLA antennas are somewhat limited.

SUMMARY OF THE INVENTION

It is, therefore, an object of the invention to provide a meander line loaded antenna (MLA) having a wide instantaneous bandwidth.

It is a still further object of the invention to provide an MLA having an instantaneous bandwidth of 7:1.

Accordingly, a wide band, meander line loaded antenna includes a first planar conductor extending orthogonally from a ground plane, a signal coupling device connected to the first planar conductor proximally to the ground plane, a second planar conductor substantially parallel to the ground plane and separated from the first planar conductor by a gap, a meander line interconnecting the first and second planar conductors across the gap, and a third conductor connecting the second planar conductor to ground.

The meander line loaded antenna may also include a fourth conductor connected to the second planar conductor and extending toward the first planar conductor for enhancing capacitance there between.

Alternatively, the present antenna may be arranged in opposed pairs, and also as two orthogonally opposed pairs for enabling circular polarization.

BRIEF DESCRIPTION OF THE DRAWINGS

A complete understanding of the present invention may be obtained by reference to the accompanying drawings, when considered in conjunction with the subsequent detailed description, in which.

DETAILED DESCRIPTION OF THE DRAWINGS

Figure 1:
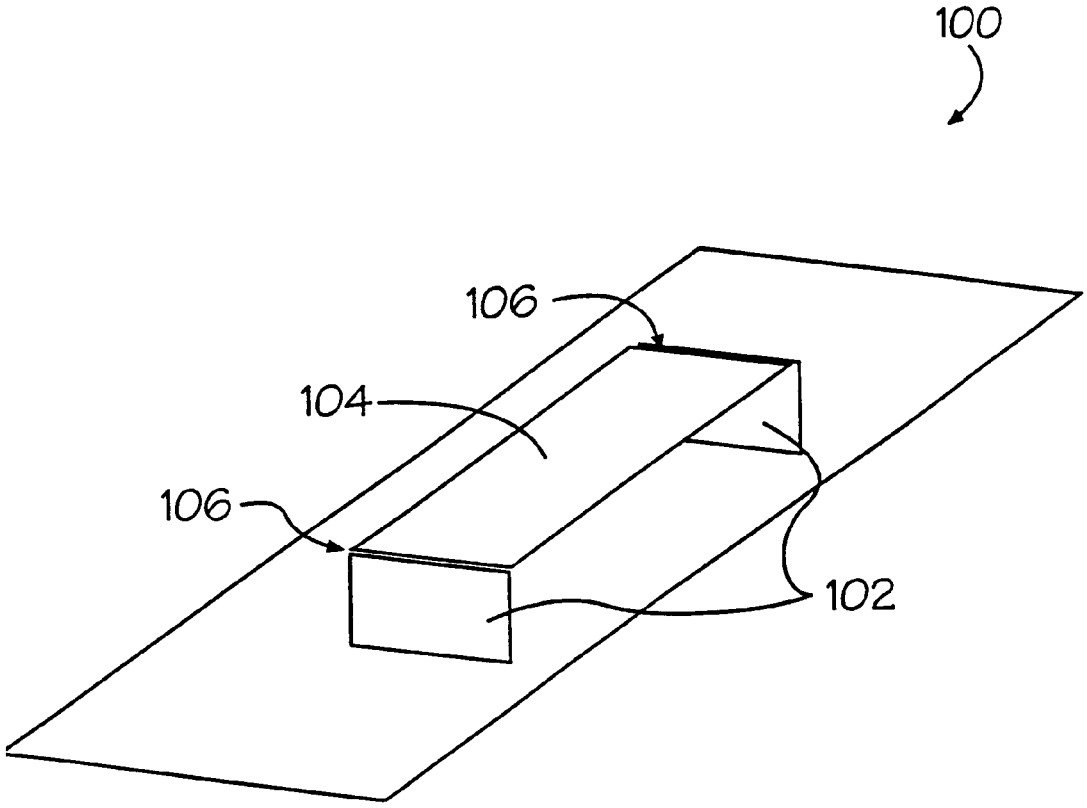
Prior Art Figure 1
FIG. 1 is a perspective view of a meander line loaded loop antenna of the prior art.
Figure 2:
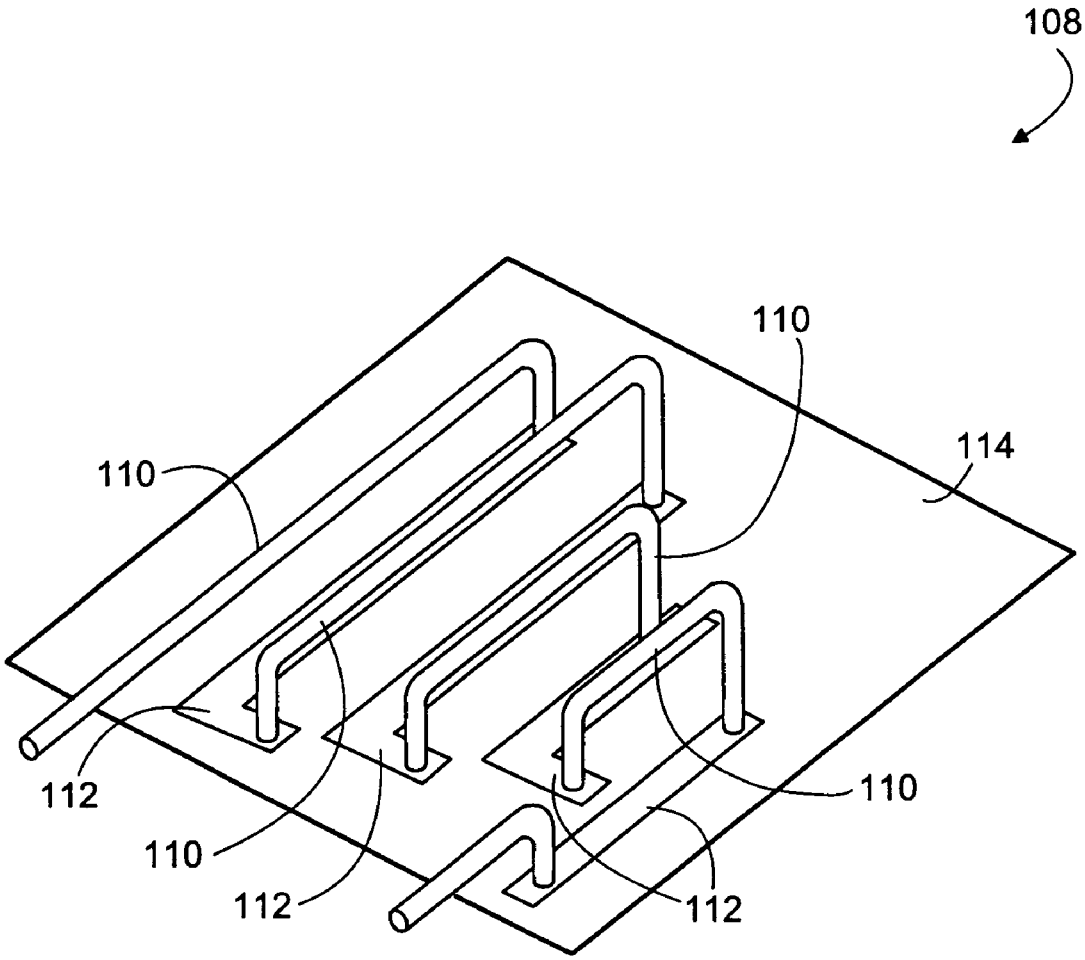
FIG. 2 is a perspective view of a meander line used as an element coupler in the meander line loaded loop antenna of FIG. 1.
Figure 3:
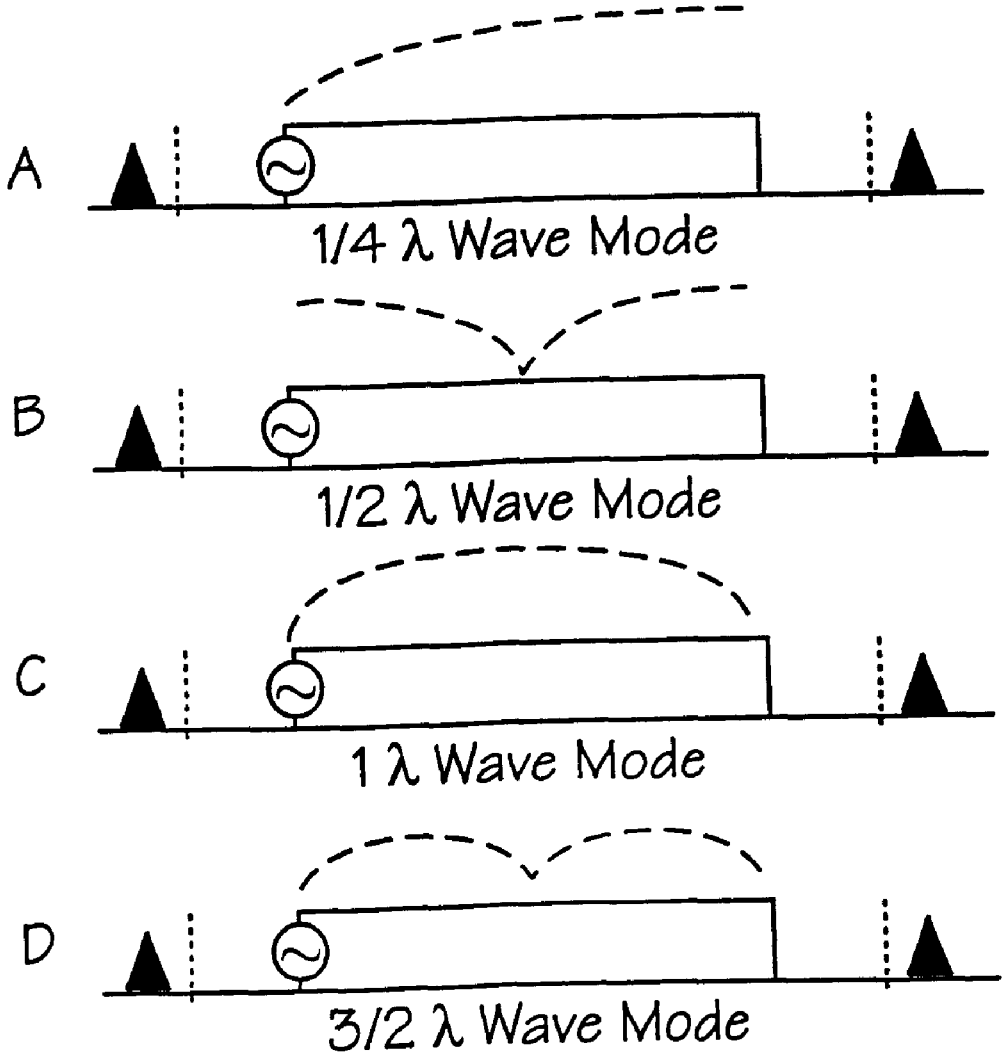
FIG. 3, consisting of a series of diagrammatic views 3A through 3D, depicts four operating modes of the antenna of FIG. 1.
Figure 4A:
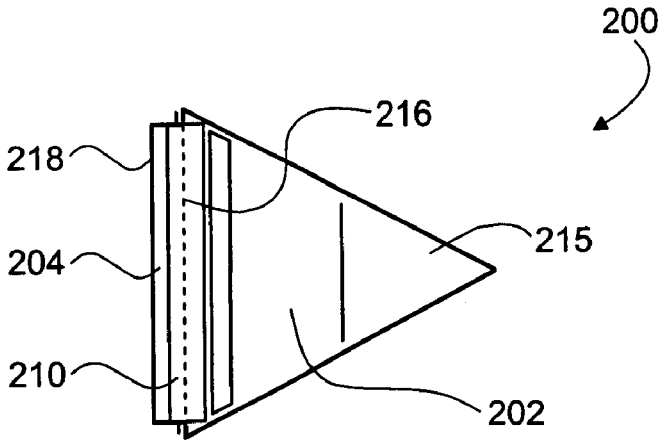
FIG. 4A is a top view of an antenna constructed in accordance with one embodiment of the present invention.
Figure 4B:
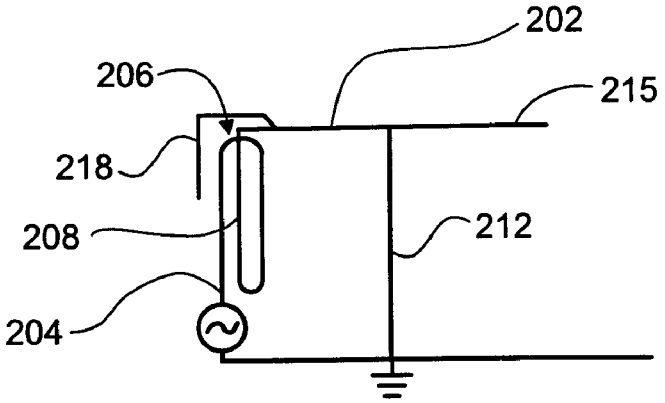
FIG. 4B is a schematic side view of the antenna of FIG. 4A.
Figure 4C:
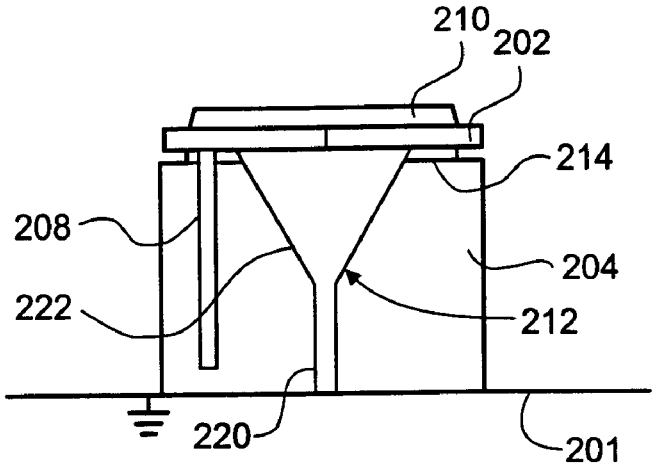
FIG. 4C is an end view of the antenna of FIGS. 4A and 4B.

The present application discloses an enhanced meander line loaded antenna which exhibits a wider instantaneous bandwidth than the previously existing MLA. Such an enhanced antenna is shown in FIGS. 4A, 4B and 4C, which are different perspective views of the same antenna 200. FIG. 4B shows a side schematic view. Antenna 200 is formed on a ground plane 201 and generally includes a vertical planar conductor 204, a signal coupling means 203, a horizontal planar conductor 202, a meander line 208 interconnecting the vertical and horizontal planar conductors 202, 204, and a further conductor 212 connecting the horizontal planar conductor 202 to ground. Also included is a shaped conductor 210 connected to horizontal conductor 202 and extending towards vertical conductor 204. The words vertical and horizontal are nominally used herein with reference to ground plane 201. Ground plane 201 may readily take the form of a finite planar conductor which may be oriented in an infinite number of positions without affecting the operation of antenna 200 relative thereto.

More specifically, vertical planar conductor 204 is generally oriented perpendicularly, or orthogonally with respect to ground plane 201. Signal coupling means 203 is connected to planar conductor 204 proximally to ground plane 201 and couples r.f. signals thereto with respect to ground plane 201. Coupling is intended to mean both the excitation of antenna 200 with a transmission signal and the extraction of signals sensed by antenna 200 for processing by a receiver. Planar conductor 204 includes a substantially straight edge 214 located along the top of conductor 204 relative to ground plane 201.

Horizontal planar conductor 202 is oriented substantially parallel to ground plane 201 and thereby perpendicularly or orthogonally to planar conductor 204. Horizontal planar conductor 202 also includes a substantially straight edge 216 which is oriented parallel and proximal to edge 214 of conductor 204. These two edges 214, 216 define a gap 206 which separates conductors 204 and 202. Gap 206 creates capacitance between planar conductors 204, 202 as determined by the spacing or size of gap 206 and the proximal lengths of edges 214 and 216. Planar conductor 202 may have a triangular shape as shown in FIG. 4A, with one corner 215 extending in the direction away from gap 206. This triangular shape may also include a pair of equilateral sides located adjacent to, or on either side of the extending corner. This triangular shape is only necessary for a further embodiment described below and is not critical to the operation of the broadest invention.

Meander line 208 is connected between planar conductors 204, 202 and across gap 206. Meander line 208 may be constructed in the same manner as meander line 108 of the prior art and may include two or more sequential sections having alternating impedance values. Although only two sections are shown for meander line 208, the actual number used will depend upon the desired electrical length for the particular application. Meander line 208 is physically mounted to vertical planar conductor 204, which creates a relative ground plane for meander line 208. FIG. 4C shows that meander line 208 has the width of a typical transmission line for the purpose of creating the relative functional impedance values thereof.

Shaped conductor 210 is used to further enhance the capacitance created between planar conductor 204 and 202. Conductor 210 is connected to horizontal conductor 202 and extends towards vertical conductor 204, and it includes a planar section 218 which is oriented substantially parallel to vertical planar conductor 204. Conductor 210 creates additional capacitance in relation to planar conductor 204 by means of its proximity thereto. Such proximity is determined by the relative closeness of conductor 210 and 204 and the relative proximal surface areas thereof. For this reason, conductor 210 is adapted for adjustment with respect to conductor 204. In one form, conductor 210 may be made from a malleable material, such as copper, which holds its shape after being bent into the desired position. Additionally, a more precise physical spacer made of dielectric material may be placed between the conductors 210, 204. Likewise, any other suitable arrangement may be used. The addition of planar section 218 further increases capacitance by providing a greater proximal surface area.

As mentioned horizontal planar conductor 202 is connected to ground by a further conductor 212. Conductor 212 may take various forms and is shown in FIG. 4C to have a portion 220 thereof formed as a transmission line. Transmission line portion 220 may extend up to horizontal conductor 202, or it may have some other suitable shape such as the impedance matching section 222. Conductor 212 is shown to be oriented in parallel to vertical planar conductor 204, and in this manner a certain amount of capacitance is created depending upon the proximity of conductor 212 to planar conductor 204 and upon the relative surface area of conductor 212. Such capacitance may be varied through control of these two aspects. Conductor 212 is typically designed to have a characteristic impedance along at least a portion 220 thereof which is comparable to the overall characteristic impedance of meander line 208. The characteristic impedance of meander line 208 is nominally equal to the square root of the product of the high and low impedance values thereof.

Figure 5:
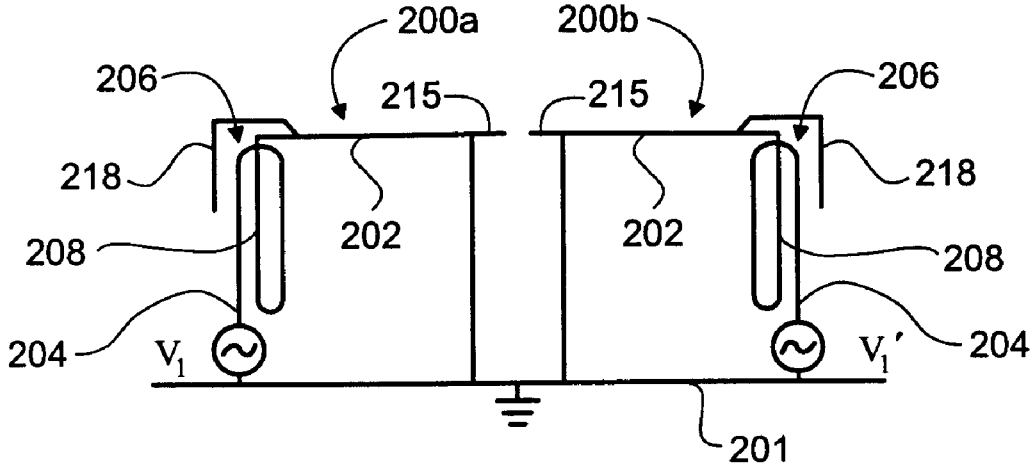
FIG. 5 is a cross-sectional schematic view of a pair of opposed MLA antennas formed with the antenna of FIG. 4.

FIG. 5 shows a schematic sectional side view of a pair of antennas 200 oriented in an opposed position and sharing the same ground plane 201, with identical components of each antenna having the same reference numbers. With the combination shown in FIG. 5, the performance of a single antenna 200 may be effectively doubled. In one mode of operation, one antenna 200*a* has a transmission signal coupled thereto, and the opposed antenna 200*b* has the inverted signal coupled thereto. This arrangement causes the horizontal planar conductors 202 of both elements to appear as a single radiating element for handling signals polarized horizontally with respect to ground plane 201. Similar reception performance is also achieved. In a preferred embodiment, antennas 200*a,* 200*b* are symmetrically aligned with the extending corners 215 or other similar leading edges being proximally located. The horizontal planar conductors 202 are not limited to having a triangular shape, and may be any other suitable shape, such as rectangular.

Figure 6:
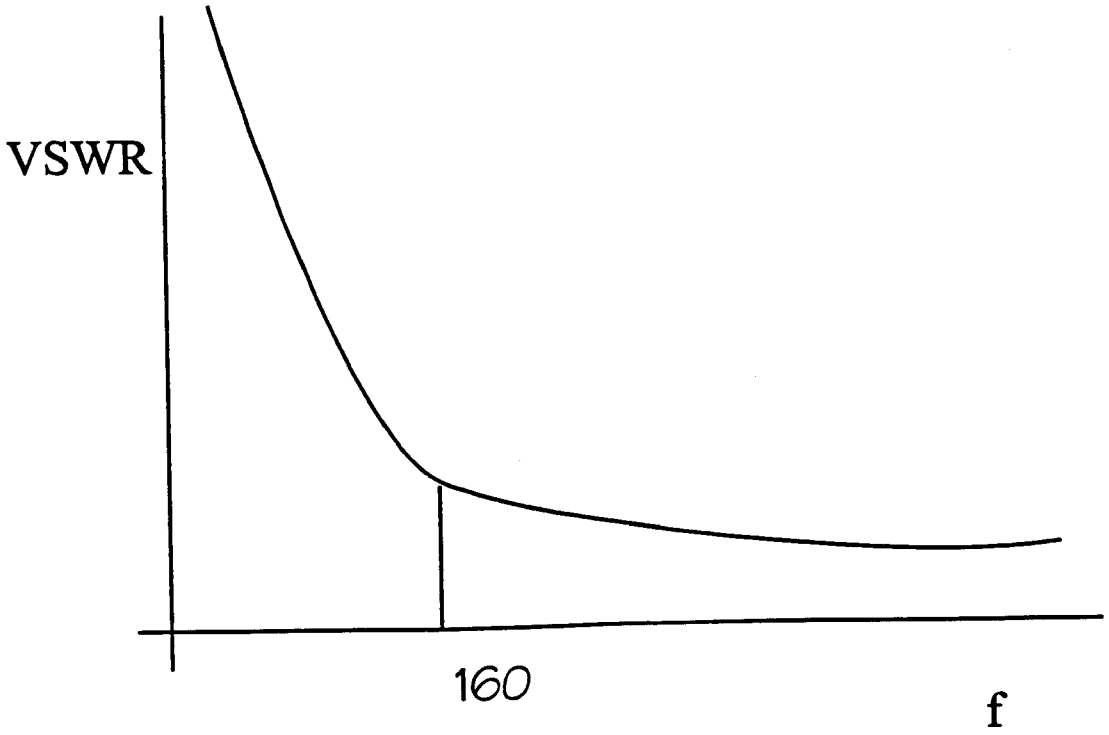
FIG. 6 is a graph of a VSWR of a conventional loop antenna similar to the MLA but without the meander line and other modifications.

FIG. 6 shows the voltage standing wave ratio (VSWR) for antenna 200 without either meander line 208 or shaped conductor 210. In the example chosen for purposes of this disclosure, the cutoff frequency is near 160 MHz and the bandwidth is slightly over 4:1.

Figure 7:
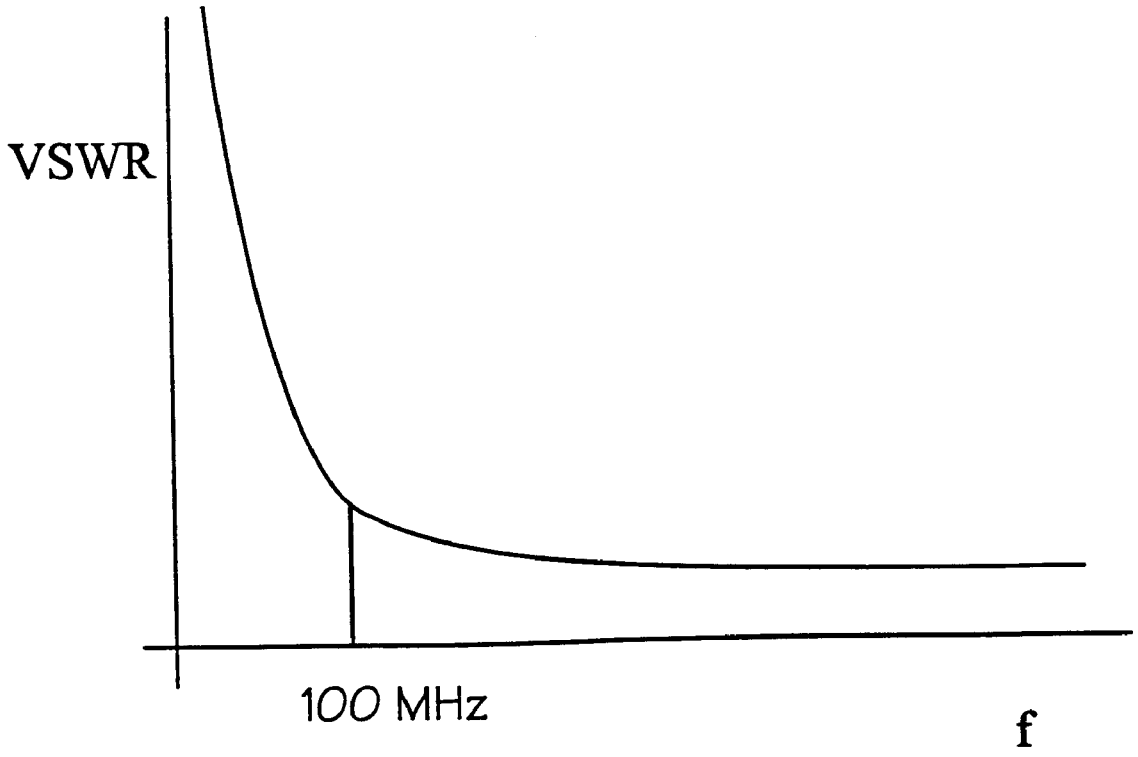
FIG. 7 is a graph of a VSWR of an MLA constructed in accordance with the present application.

FIG. 7 shows the effect of the meander line 208 and shaped conductor 210 on the same antenna as the example of FIG. 6. The cutoff frequency has been lowered to approximately 100 MHz and the overall instantaneous bandwidth has been increased to 7:1. Although the VSWR in this example remains good over 700 MHz, the antenna radiation pattern looses its omni-directional characteristic. Thus, usable bandwidths of 7:1 have been measured using this antenna design.

In operation, the opposed pair of meander line loaded antennas 200*a,* 200*b* operates in the monopole or vertical polarization mode relative to ground plane 201, when the signal couplers $V_1$ and $V_1'$ are fed with the same signal. This same opposed pair operates in a loop mode for horizontal polarization relative to ground plane 201, When the signal couplers are fed with inverse signals, $V_1$ and $-V_1'$.

Figure 8:
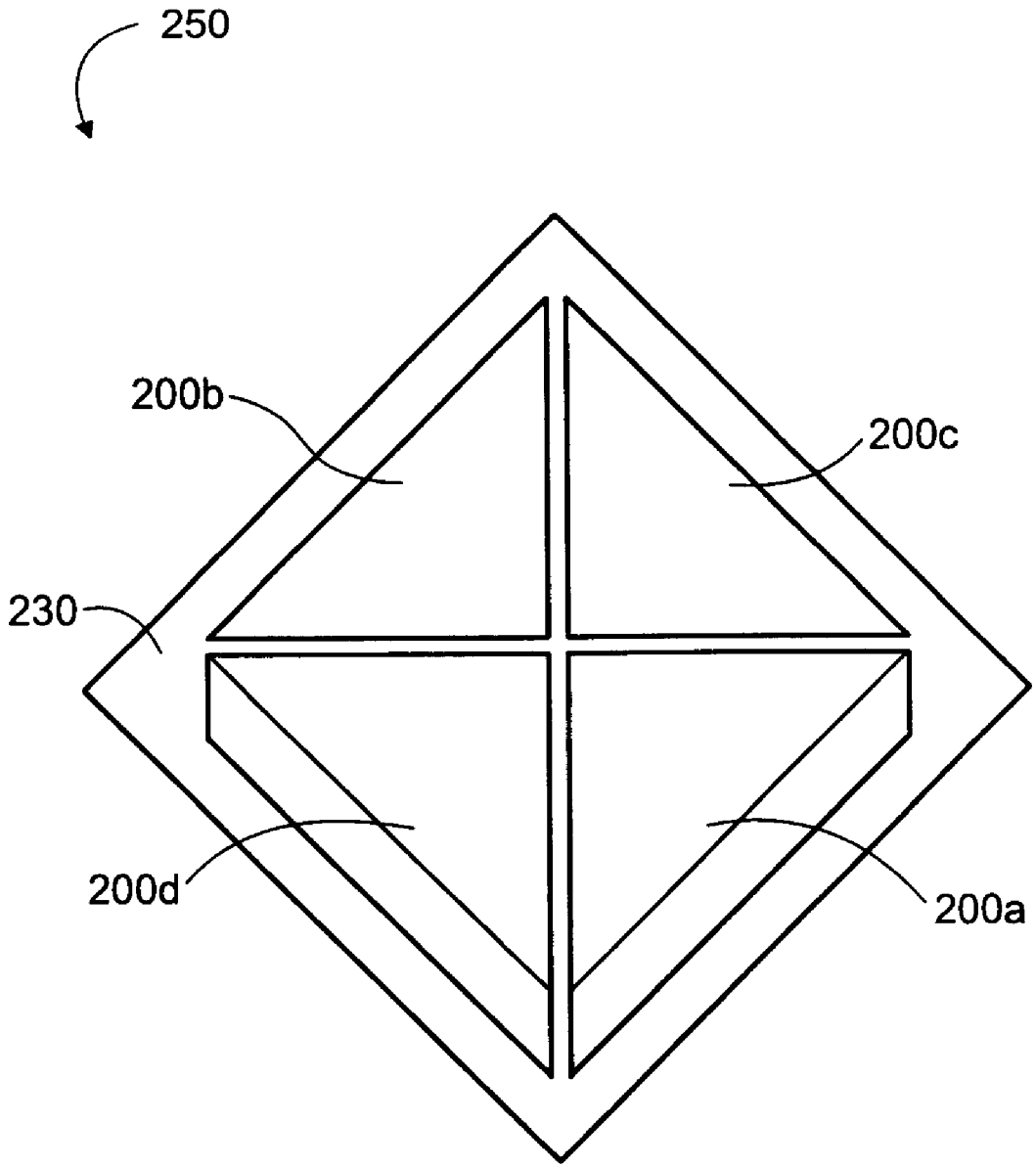
FIG. 8 is a perspective view of two pairs of opposed MLA antennas arranged in quadrature.

FIG. 8 shows a perspective view of two opposed pairs of meander line loaded antennas 200*a*–200*b,* 200*c*–200*d,* sharing a common ground plane 230 and forming a quad antenna 250. Both opposed pairs are identical and are orthogonally arranged with respect to each other, and the extending corners 215 (FIGS. 4 and 5) are all proximally located. FIG. 8 more clearly shows the symmetrical alignment of each of the opposed pairs. The triangular shape of horizontal planar conductor 202 is used in this embodiment to allow the proximal location of all of the extending corners. Because the extending corners 215 of each pair are not directly connected, circularly polarized signals created by both pairs are generated at the same central point in space and are not displaced from each other along a central axis orthogonal to ground plane 230. This provides the circularly polarized signals so generated with high polarization purity.

Figure 9:
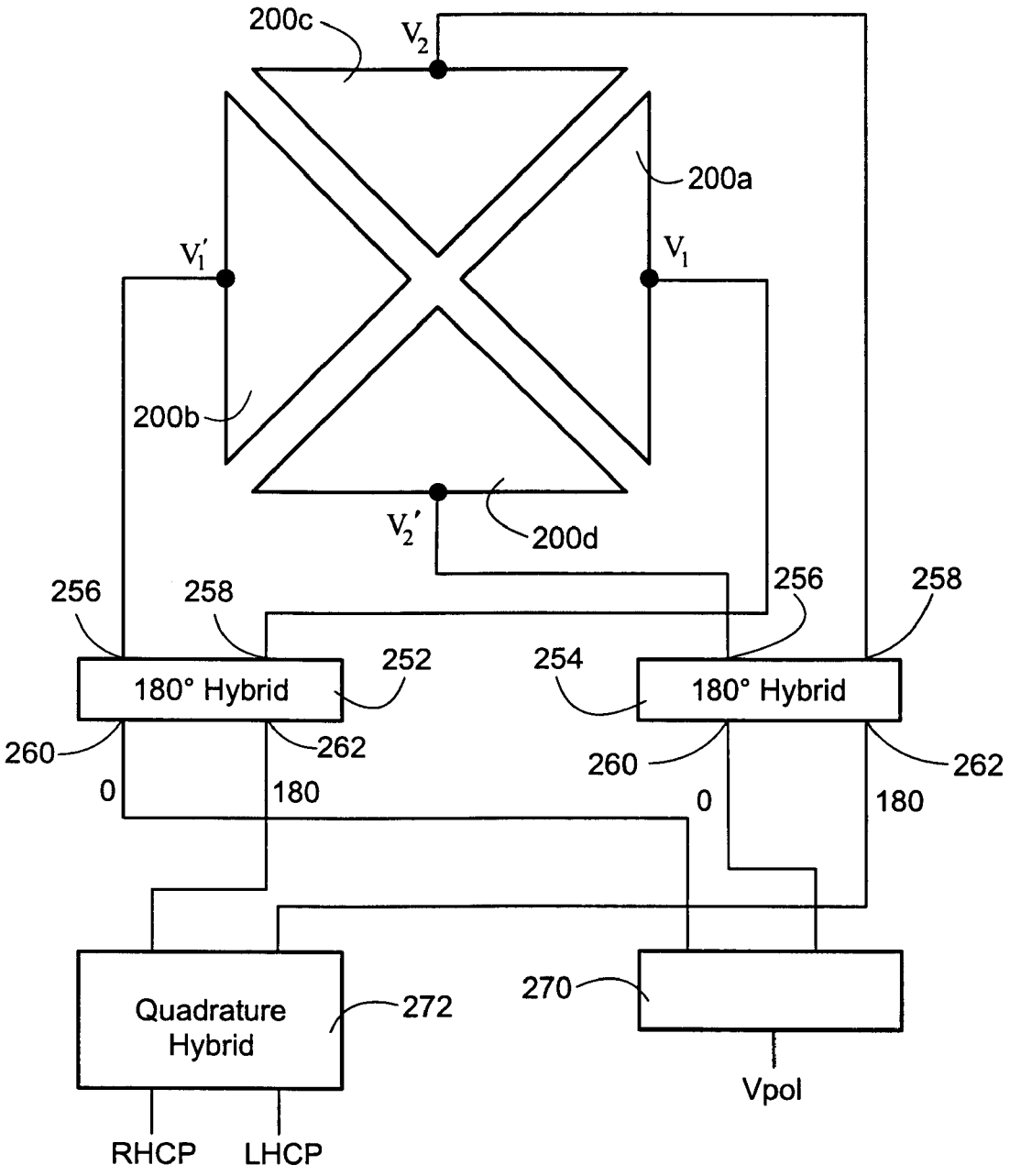
FIG. 9 is a schematic view of the antenna of FIG. 8 including circuitry used for providing quadrature coupling for the combined antenna.

FIG. 9 shows an example of coupling circuitry which may be used simultaneously for both circularly and vertically polarized signals. Each of the opposed pairs 200*a*–200*b,* 200*c*–200*d* is coupled to a respective inverse hybrid circuit 252, 254, commonly known as "180°" hybrids. Inverse hybrid circuits 252, 254 each has a pair of antenna ports 258, 256 coupled to their respective opposed antennas 200*a*–200*b,* 200*c*–200*d,* and a pair of input/output ports 260, 262. Signals coupled to the "0" input/output port 260 of each inverse hybrid are thereby coupled equally through antenna ports 256, 258, and signals coupled to the "180" input/output port 262 are coupled inversely, or out of phase through antenna ports 256, 258. Likewise in a receive mode, the "0" input/output port 260 combines the signals from both antenna ports 256, 258 with an in-phase relationship, and the "180" input/output port 262 combines the signals from both antenna ports 256, 258 with an out-of-phase relationship.

The input/output ports 260, 262 are then coupled by type, with the "0" ports 260 coupled to a simple power combiner/splitter 270 for handling vertically polarized signals and the "180" ports 262 coupled to a quadarature converter 272 to handle circularly polarized signals. By this arrangement, horizontally polarized components of a received signal are coupled by inverse hybrids 252, 254 to quadarture hybrid 272. Quadrature hybrid 272 mixes the signals with a quadrature separation to allow detection of circularly polarized signals. The quadrature mixing is performed twice with the inverse hybrid signals in different order to allow detection of both left-hand and right-hand polarized signals. In this manner, and because of the circular polarization purity of antenna 250, both directions of polarization may be simultaneously used for independent signals.

As mentioned, antenna 250 may also be simultaneously used to receive vertically polarized signals. The in-phase signals produced by inverse hybrids 252, 254 are simply combined to sum the contribution from all of the antenna elements. Also, the circuitry of FIG. 9 functions in the analogous manner for handing transmission signals. A signal coupled to either of the VPOL, LHCP or RHCP ports will be transmitted accordingly.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A wide band, meander line loaded antenna, comprising:

conductor means defining a ground plane;

a first planar conductor extending orthogonally from the ground plane;

signal coupling means connected to the first planar conductor proximally to the ground plane;

a second planar conductor substantially parallel to the ground plane and separated from the first planar conductor by a gap;

a meander line interconnecting the first and second planar conductors across the gap; and a third conductor oriented parallel to the first planar conductor and connecting the second planar conductor to ground.

2. The antenna of claim 1, further comprising a fourth conductor connected to the second planar conductor and extending toward the first planar conductor for enhancing capacitance there between.

3. The antenna of claim 2, wherein the fourth conductor is adapted for adjustment relative to the first planar conductor to vary the capacitance there between.

4. The antenna of claim 3, wherein the fourth conductor has a planar member thereof which extends substantially parallel to the first planar conductor and is adjustable as to its proximity to the first planar conductor.

5. The antenna of claim 1, wherein the meander line is a slow wave structure having sequential sections with different characteristic impedance values including at least one section with a relatively lower impedance value and at least one section with a relatively higher impedance value, and further wherein the third conductor has a characteristic impedance value approximately equal to the square root of the product of the lower and higher impedance values of the meander line.

6. The antenna of claim 5, wherein the third conductor is a transmission line having an inductance and is separated from the first planar element by a distance which determines capacitance there between.

7. The antenna of claim 1, wherein the first and second planar conductors each has a substantially straight edge located along the gap.

8. The antenna of claim 7, wherein the second planar conductor has a triangular shape with a corner thereof extending away from the gap.

9. The antenna of claim 8, further comprising a second meander line loaded antenna identical to the first said meander line loaded antenna of claim 8 and sharing the same ground plane, wherein the first said and second antennas form an opposed first pair of meander line loaded antennas with the respective extending corners located in proximity to each other.

10. The antenna of claim 9, wherein the triangular shape of the second planar conductors of the first said and second antennas each includes two equilateral sides located adjacent the extending corner, and further wherein the first said and second antennas are symmetrically opposed to each other with their respective extending corners being proximally located.

11. The antenna of claim 10, further comprising a second pair of symmetrically opposed meander line loaded antennas identical to the first pair of meander line loaded antennas of claim 10, wherein the second pair of meander line loaded antennas shares the same ground plane as the first pair and is located orthogonally with respect to the first pair with the extending corners of each of the meander line loaded antennas being proximally located.

12. The antenna of claim 11, further comprising circuit means for coupling orthogonal radio frequency signals to and from the orthogonally located first and second pair of meander line loaded antennas.

* * * * *